United States Patent [19]

Erickson

[11] 4,249,766

[45] Feb. 10, 1981

[54] BOTTLE SEPARATING AND CONNECTING BAND

[76] Inventor: Gerald Erickson, P.O. Box 747, Palm Beach, Fla. 33480

[21] Appl. No.: 29,716

[22] Filed: Apr. 13, 1979

[51] Int. Cl.[3] ..... B65D 71/04

[52] U.S. Cl. ..... 294/87.2; 206/150; 206/620

[58] Field of Search ..... 294/31.2, 87 R, 87.2, 294/87.28; 206/139, 145, 150, 160, 199, 427, 428, 620, 628, 630; 215/100 A; 224/45 A, 45 AA

[56] References Cited

U.S. PATENT DOCUMENTS

| | | | |
|---|---|---|---|
| 2,996,329 | 8/1961 | Glazer | 294/87.2 |
| 2,997,169 | 8/1961 | Poupitch | 294/87.2 X |
| 3,330,408 | 7/1967 | Wanderer | 294/87.2 X |
| 3,721,337 | 3/1973 | Braun et al. | 294/87.2 X |
| 3,727,754 | 4/1973 | Cunningham | 206/150 |
| 3,752,305 | 8/1973 | Heyne | 294/87.2 X |
| 3,938,656 | 2/1976 | Owen | 206/150 |
| 4,063,771 | 12/1977 | Calvert | 294/87.2 |

FOREIGN PATENT DOCUMENTS

| | | | |
|---|---|---|---|
| 2322478 | 11/1974 | Fed. Rep. of Germany | 294/31.2 |

*Primary Examiner*—Johnny D. Cherry
*Attorney, Agent, or Firm*—Brumbaugh, Graves, Donohue & Raymond

[57] ABSTRACT

A bottle separating and connecting band for maintaining a plurality of bottles in a relatively close cluster which includes a bottle-enclosing loop for encompassing the cluster of bottles, band portions integrally formed at opposite ends with the bottle-enclosing loop and bottle separators integrally connecting adjacent band portions to separate adjacent bottles.

1 Claim, 4 Drawing Figures

BOTTLE SEPARATING AND CONNECTING BAND

This invention relates to a bottle separating and connecting band for maintaining a plurality of bottles in a relatively close cluster.

Bottle carriers capable of supporting a plurality of bottles by their necks have been heretofore proposed, for example, the bottle carriers of the type disclosed in U.S. Pat. Nos. 3,633,962, issued Jan. 11, 1972, and 4,093,295, issued June 6, 1978. Although bottle carriers of this type have provided effective and economical carriers, the bottles are free to move relative to and strike one another with possible damage to the bottles.

The present invention provides a novel bottle separating and connecting band which can be used in conjunction with these bottle carriers to maintain the bottles in a close cluster.

The bottle separating and connecting band is integrally formed of relatively resilient material and includes a bottle enclosing loop which encircles the package of bottles, band portions integrally formed at opposite ends with said bottle enclosing loop and forming with the loop individual retaining bands around each bottle and bottle separators integrally formed with adjacent band portions to separate adjacent bottles. When the band is used in conjunction with a conventional bottle carrier, for example, of the type capable of supporting a plurality of bottles by their necks, the band maintains the cluster of bottles in a closely spaced cluster and properly oriented with respect to each other.

In a preferred embodiment of the bottle separating and connecting band of the present invention, removal of a bottle from the band is facilitated by forming a plurality of pull tabs integrally with the bottle enclosing loop, one for each bottle, so that the band can be broken at different locations for the removal of a bottle. To facilitate breaking the band, the band is preferably weakened adjacent the tab.

For a full understanding of the present invention reference should be made to the detailed description which follows and to the accompanying drawings, in which.

Figure 1:
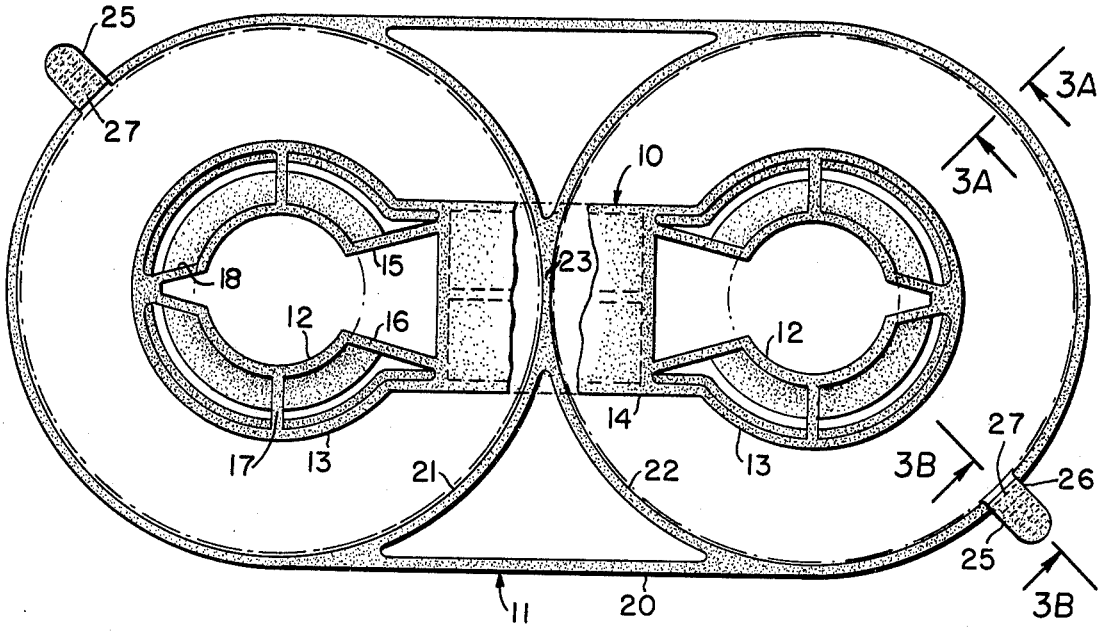
FIG. 1 is a plan view of the bottle separating and connecting band of the present invention with a conventional bottle carrier superimposed over it to illustrate the manner in which the band and carrier are used in conjunction with each other.
Figure 2:
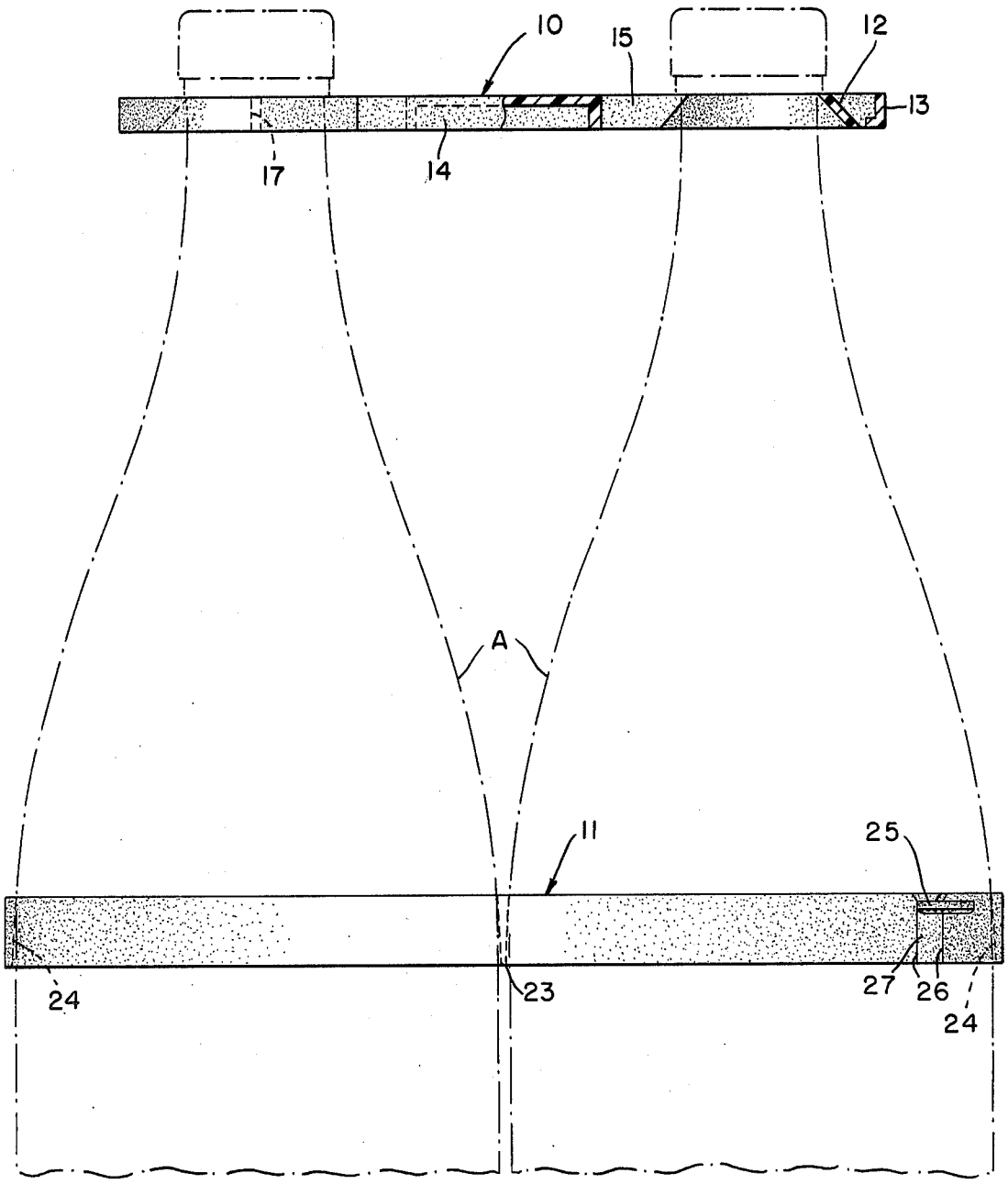
FIG. 2 is an elevational view of the bottle carrier and band shown in FIG. 1 with the bottles packaged therein shown in phanton lines.

FIGS. 1 and 2 of the drawings show a conventional bottle carrier 10 of the type disclosed in U.S. Pat. No. 4,093,295 and the bottle separating and connecting band 11 of the present invention as it would be used in conjunction with the bottle carrier 10. The bottles A are shown in phanton lines in FIG. 2.

The bottle carrier 10 includes a pair of split collars 12 supported in oppositely oriented relationship at opposite ends of the bottle carrier. The split collars 12 are accommodated within individual frames 13 mounted at opposite ends of a connecting bar 14 which serves as a handle for carrying the package. The ends of the split collar are connected to the inner leg of the respective individual frame by a pair of connections 15 and 16 which extend diagonally from the split ends away from each other toward the leg of the frame. This angular relationship of the connections permits the split collar to be forced open to increase the size of the opening to facilitate the insertion and removal of a bottle. It also provides support for the split collar to prevent it from sagging under the weight of a bottle and offers resistance to accidental spreading of the split collar when it is supporting a bottle therein.

Each collar is also supported in its frame 13 by transverse connections 17 and by a yoke 18 directly opposite the opening. The yoke 18 serves as a pivot for the two components of the collar to facilitate their spreading for the insertion and removal of a bottle. For a more detailed description of the structure and operation of the bottle carrier, reference can be made to the above-identified patent.

The bottle separating and connecting band 11 includes a bottle enclosing loop 20 which encompasses therein a plurality of bottles forming the package. The package illustrated in the drawings contains only two bottles, but the package can include two, three, four, six or more bottles.

Semi-circular band portions 21 and 22 are provided within the bottle enclosing loop 20 and are integrally connected at their ends to the loop to define individual retaining bands for each bottle. The band portions 21, 22 are integrally connected intermediate their ends to form a bottle separator 23 intermediate adjacent bottles. The bottle separator 23 can be a thin single band at the point of tangency of the band portions 21, 22 or it can include a wider bridge connection between the band portions 21, 22 depending on the spacing desired.

Figure 3A:
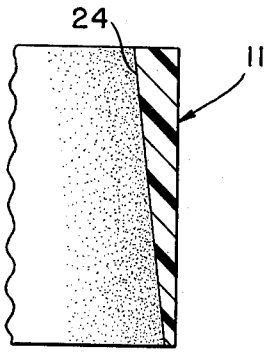
FIGS. 3A and 3B are sectional views of the band taken along the lines 3A—3A and 3B—3B, respectively, of FIG. 1 looking in the direction of the arrows.
Figure 3B:
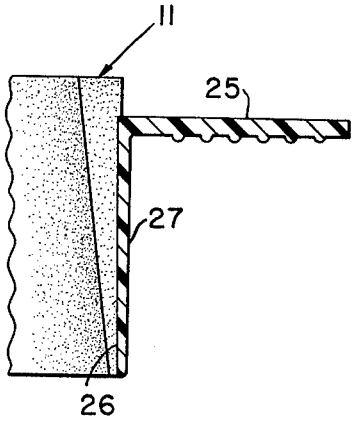

The bottle separating and connecting band 11 can be designed to engage the bottles at any height below the carrier 10, but preferably they are employed at about shoulder height where the outer surface of the bottle is somewhat tapered because of its decreasing circumference. Toward this end, as best shown in FIG. 3A, the inner surface 24 of the band is tapered in generally complementary fashion to the bottle so that the upper thickness of the band is greater than the lower thickness thereof. This taper also facilitates the application of the band, permitting it to be readily slipped from above onto a plurality of bottles to be packaged.

To facilitate the removal of a bottle, the band is preferably provided with a plurality of protruding pull tabs 25 which permit the band to be broken at different locations to release selected bottles. To facilitate breaking the band, the band is preferably weakened at the protruding pull tab by a pair of weakened lines 26 defining a strip 27 of reduced thickness in the band. There is preferably a pull tab provided for each bottle in the package so that the selected bottles can be removed without releasing the other bottles of the package.

The bottle separating and connecting band of the present invention can be made of any suitable resilient plastic material, but preferably it is injection molded in one piece of polypropylene, the preferred material for the bottle carrier 10.

The invention has been shown in a single preferred form and by way of example only, and many modifications and variations may be made therein without departing from the spirit of the invention. The invention, therefore, is not to be limited to any specified form or embodiment, except in so far as such limitations are expressly set forth in the claims.

I claim:

1. A bottle carrying apparatus for carrying bottles in a close, tight cluster comprising a carrier frame for engaging and locking together the cluster of bottles, bottle engaging means within the carrier frame for engaging the necks of the bottles and including a pair of spreadable release elements to permit a bottle to be removed from the frame by pivoting the lower end thereof away from an adjacent bottle to force the neck of the bottle between said spreadable release elements, a bottle separating and connecting band for encompassing the cluster of bottles at a distance substantially below the carrier frame, a loop portion forming part of said band for encompassing a cluster of bottles, band portions integrally formed at opposite ends with said bottle encompassing loop portion and forming with parts of said loop portion individual retaining bands for each bottle, a bottle separator integrally connecting adjacent band portions to separate adjacent bottles, a plurality of pull tabs formed on said band for breaking the loop portion at different locations to release selected bottles, a weakened portion in the band adjacent each pull tab to facilitate breaking the band, said band encompassing tapered surfaces of the necks of the bottles and said bottle engaging band portions being characterized in that the upper edges are thicker than the lower edges, and inner surfaces of the bottle engaging band portions tapered in substantially complementary fashion to the surfaces of the tapered portions of the bottles which they engage, the weakened portion adjacent each pull tab being of uniform thickness substantially less than the thicker upper edges of the band portions to facilitate breaking the band.

* * * * *